United States Patent [19]

Vauk et al.

[11] Patent Number: 4,849,093

[45] Date of Patent: Jul. 18, 1989

[54] CATALYTIC AROMATIC SATURATION OF HYDROCARBONS

[75] Inventors: Dennis A. Vauk, Santa Ana; Milan Skripek, Fullerton, both of Calif.

[73] Assignee: Union Oil Company of California, Los Angeles, Calif.

[21] Appl. No.: 9,808

[22] Filed: Feb. 2, 1987

[51] Int. Cl.[4] ..... C10G 45/00

[52] U.S. Cl. ..... 208/143; 585/265; 585/266; 585/269; 585/270; 208/144; 208/145; 208/72; 208/73; 208/74; 208/75; 208/210

[58] Field of Search ..... 208/143, 144, 145, 72–75, 208/210; 585/265, 266, 270, 269

[56] References Cited

U.S. PATENT DOCUMENTS

| | | | |
|---|---|---|---|
| 1,974,057 | 9/1934 | Steffen et al. | 585/265 |
| 2,138,881 | 12/1938 | Pyzel | 585/265 |
| 2,481,921 | 9/1949 | Gwynn | 585/265 |
| 2,755,317 | 7/1956 | Kassel | 585/265 |
| 3,070,640 | 12/1962 | Pfeiffer et al. | 585/265 |
| 3,147,210 | 9/1964 | Hass et al. | 585/265 |
| 3,236,764 | 2/1966 | Herder et al. | 585/269 |
| 3,239,449 | 3/1966 | Craven et al. | 585/269 |
| 3,318,965 | 5/1967 | Hutto et al. | 585/265 |
| 3,369,998 | 2/1968 | Bercik et al. | 585/270 |
| 3,387,049 | 6/1968 | Craig et al. | 585/265 |
| 3,404,190 | 10/1968 | Proctor, Jr. | 585/265 |
| 3,405,190 | 10/1967 | Logemann et al. | 585/265 |
| 3,527,695 | 9/1970 | Lawrance et al. | 208/143 |
| 3,592,757 | 3/1969 | Baral | 208/143 |
| 3,654,139 | 4/1972 | Winsor et al. | 585/265 |
| 3,767,562 | 10/1973 | Sze et al. | 208/143 |
| 3,770,619 | 11/1973 | Derrien et al. | 208/143 |
| 3,823,085 | 7/1974 | Kochie | 208/143 |
| 3,824,181 | 7/1974 | Stauffer et al. | 208/143 |
| 3,899,543 | 8/1975 | Cosyns et al. | 208/143 |
| 3,979,277 | 9/1976 | Hayes | 208/143 |
| 4,019,976 | 4/1977 | Cosyns et al. | 585/270 |
| 4,061,563 | 12/1977 | Hilfman | 208/143 |
| 4,085,035 | 4/1978 | Wristers | 208/143 |
| 4,087,353 | 5/1978 | Rausch | 208/143 |
| 4,100,058 | 7/1978 | Hilfman | 208/143 |
| 4,108,912 | 8/1978 | Takemura et al. | 585/270 |
| 4,175,033 | 11/1979 | Hilfman | 208/143 |
| 4,202,758 | 5/1980 | O'Hara et al. | 208/143 |
| 4,236,219 | 11/1980 | Killebrew, Jr. et al. | 208/143 |
| 4,240,900 | 12/1980 | Gilbert et al. | 208/143 |
| 4,325,804 | 4/1982 | Everell et al. | 208/143 |
| 4,627,910 | 12/1986 | Millman | 208/143 |

*Primary Examiner*—H. M. S. Sneed
*Assistant Examiner*—Helane Myers
*Attorney, Agent, or Firm*—Alan H. Thompson; Gregory F. Wirzbicki

[57] ABSTRACT

In the catalytic processing of aromatic hydrocarbon compounds, a hydrocarbon oil is successively contacted at aromatic saturation conditions with a catalyst in a first reaction zone and contacted at a lower temperature with a second portion of the catalyst in the same reactor or in multiple reactors.

20 Claims, 2 Drawing Sheets

CATALYTIC AROMATIC SATURATION OF HYDROCARBONS

BACKGROUND OF THE INVENTION

This invention relates to catalytic hydrocarbon processing, and particularly to hydrocarbon hydroprocessing, such as the process involving catalyzing the reaction of hydrogen with aromatic compounds. More particularly, this invention is directed to a process for saturating aromatic compounds in hydrocarbon liquids.

During the course of catalytic refining of hydrocarbons, heterocyclic compounds, including oxygen compounds, are removed from hydrocarbon oil. Aromatic compounds contained in the hydrocarbon oil are also contacted during the refining process with a catalyst in the presence of hydrogen, causing conversion of such aromatic compounds to more saturated forms, i.e., the aromatic compounds are hydrogenated.

Economic considerations have provided new incentives for catalytic conversion of the aromatic fractions to more marketable products. Today there is a steadily increasing demand for relatively non-aromatic middle distillate products boiling in the range of about 300°–700° F. Such products include, for example, aviation turbine fuels, diesel fuels, solvents and the like. Products in this boiling range are conventionally produced by the hydrotreating and/or hydrocracking of various refinery streams boiling in or above the desired product range. Hydrotreating and hydrocracking operations generally effect a substantial partial hydrogenation of polycyclic aromatics, but the resulting products still contain a relatively high percentage of monoaromatic hydrocarbons. Further hydrogenation of these products is desired in many cases to produce acceptable solvent products or to meet specifications (smoke point and luminometer number) for jet fuels, (cetane number) for diesel fuels, etc.

Accordingly, a need still exists for an improved process for reducing the content of aromatic hydrocarbon compounds to specified levels in a product hydrocarbon oil. It is, therefore, a major object of the present invention to provide a process for saturating aromatic compounds in a hydrocarbon oil, and more specifically to provide a hydrogenative catalytic aromatic saturation process while simultaneously hydrocracking a substantial proportion of the hydrocarbon oil.

It is another object of the invention to provide a multi-reaction zone process for the catalytic saturation of aromatic compounds in a hydrocarbon oil, and more specifically to provide a process for substantially hydrogenating an aromatic-containing hydrocarbon oil to obtain improved products of low aromatic content.

A further object of the invention is to provide hydrocarbon products of reduced aromatic content in a process utilizing less refining catalyst.

These and other objects and advantages of the invention will become apparent from the following description.

SUMMARY OF THE INVENTION

The present invention is directed to a process for saturating aromatic hydrocarbon compounds in a hydrocarbon oil by successively contacting at least two portions of a particulate catalyst with the oil under aromatic saturation conditions. In the process of the invention the reaction(s) involved in saturating the aromatic hydrocarbons is (are) equilibrium limited. The weighted average catalyst bed temperature of a downstream portion of the catalyst is lower than the weighted average catalyst bed temperature of an upstream second portion of the catalyst. This takes advantage of a higher initial aromatics saturation reaction rate in the upstream section at higher temperatures and a subsequently more favorable chemical equilibrium between aromatics and saturates in the downstream section at lower temperatures. The net effect in the downstream section is a higher rate of aromatics saturation at a lower temperature.

In a multi-reaction zone embodiment, a catalyst effective for aromatic saturation is employed in at least two reaction zones wherein the first reaction zone has a higher weighted average catalyst bed temperature than that of the second and subsequent reaction zones. The final product hydrocarbon from a single or multi-reaction zone process of the invention contains a hydrocarbon oil having a selectively reduced aromatics content resulting from expending less energy in downstream sections.

In view of the aromatic saturation/desaturation equilibrium reaction, the extent of the temperature decrease between upstream and downstream portions of a catalyst bed in a single reactor, or between upstream reaction zones and downstream reaction zones in a multi-reactor process, is determined by the extent of the decrease in the observed aromatic saturation reaction rate constant compared to the extent of aromatic saturation as chemical equilibrium is approached. The temperature is decreased to a selected lower temperature at a point along the catalyst bed where the observed aromatics saturation rate has decreased to within about 10 percent of the rate at the selected lower temperature. At such a point along the catalyst bed, or at a selected downstream reactor in a multi-reactor catalyst bed embodiment, the aromatic saturation reaction then proceeds at the lower temperature where the chemical equilibrium between aromatics and saturates favors saturation.

A BRIEF DESCRIPTION OF THE FIGURES

DETAILED DESCRIPTION OF THE INVENTION

Figure 1:
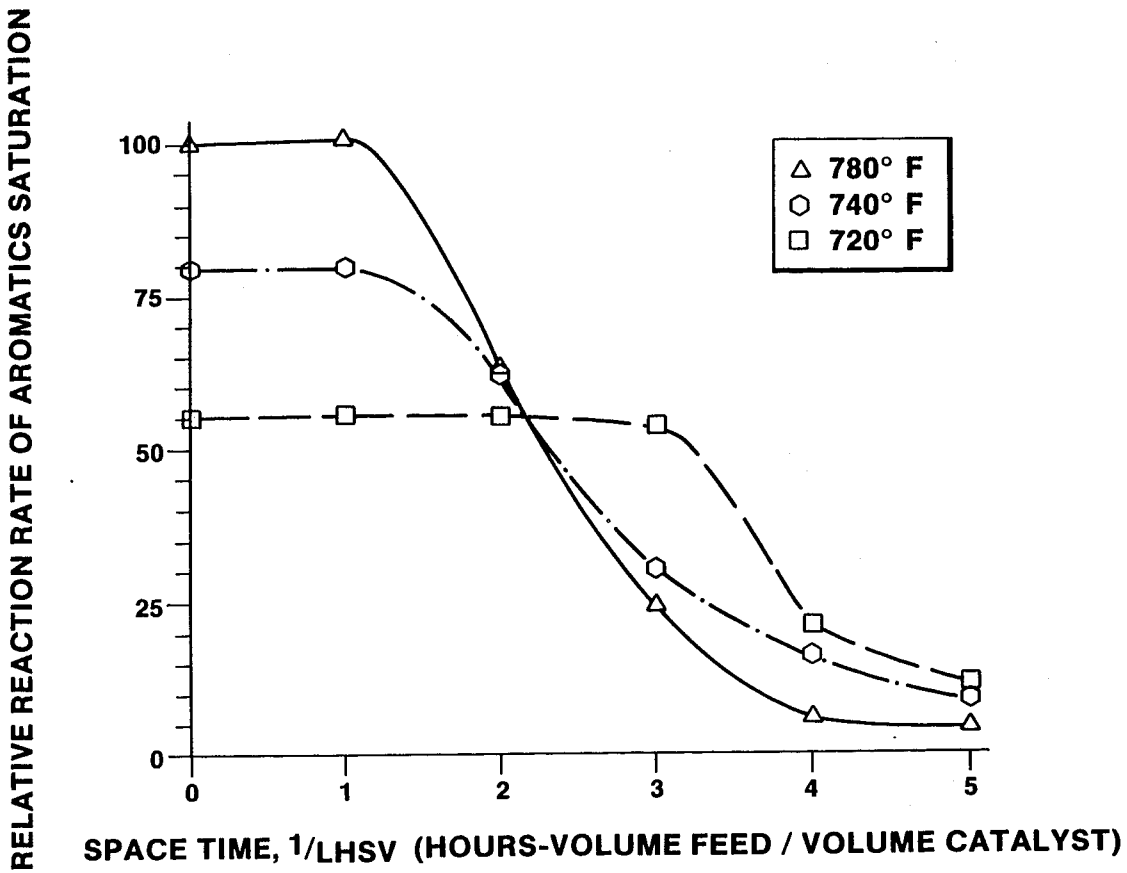
FIG. 1 illustrates the relative reaction rates of aromatic saturation in relation to the oil/catalyst space time.

A hydrocarbon oil containing aromatic compounds is catalytically treated in the presence of hydrogen in an aromatic saturation reaction zone containing a catalyst bed having a temperature maintained in a downstream portion of the bed that is typically at least 5° F. lower than that in an upstream portion of the bed. The oil may also be contacted serially in two or more reaction zones with the same catalyst at aromatic saturation conditions. The downstream reaction zones have a lower weighted average catalyst bed temperature than the weighted average catalyst bed temperatures of the upstream reaction zones and, optionally, may also contain a smaller amount of catalyst. The extent of reduction of the temperature (and, optionally, the amount of catalyst reduction) in the downstream catalyst bed or downstream reaction zone (as compared to that in the upstream portions) is, in part, controlled by the observed aromatic saturation—aromatic desaturation equilibrium reactions occurring during the catalytic process.

The invention is directed to a process employing particulate catalysts, and more preferably, hydroprocessing catalysts comprising hydrogenation metals on a support, and more preferably still of an aromatic saturation catalyst containing Group VIII and/or Group VIB metal components on a support material typically containing a porous refractory oxide. Porous refractory oxides useful in the particulate catalyst of the invention includes silica, magnesia, silica-magnesia, zirconia, silica-zirconia, titania, silica-titania, alumina, silica-alumina, and the like. Also useful are molecular sieves, including both zeolitic and non-zeolitic materials. Mixtures of the foregoing oxides are also contemplated especially when prepared as homogeneously as possible. The preferred refractory oxide material comprises aluminum and is usually selected from the group consisting of alumina and silica-alumina. A support material containing gamma alumina is most highly preferred. Preferred catalysts useful for aromatic saturation include those disclosed in U.S. Pat. No. 3,637,484 issued to Hansford, which is incorporated by reference in its entirety herein. Other preferred hydrotreating catalysts include those disclosed in copending U.S. patent application Ser. No. 856,817, now U.S. Pat. No. 4,686,030 filed Apr. 28, 1986, which is incorporated by reference in its entirety herein.

Contemplated for treatment by the process of the invention are hydrocarbon-containing oils, including broadly all liquid and liquid/vapor hydrocarbon mixtures such as crude petroleum oils and synthetic crudes. The process may be applied advantageously to the hydrogenation of substantially any individual aromatic hydrocarbon, mixtures thereof, or mineral oil fractions boiling in the range of about 120° F. to about 1,000° F. Among the typical hydrocarbon oils contemplated are gas oils, particularly vacuum gas oils, distillate fractions of gas oils, thermally cracked or catalytically cracked gas oils, decant oils, creosote oils, shale oils, oils from bituminous sands, coal-derived oils, and blends thereof, which contain aromatic hydrocarbons and may contain sulfur, nitrogen and/or oxygen compounds. Benzene may be converted to cyclohexane and toluene to methylcyclohexane. Preferred feedstocks comprise mineral oil fractions boiling in the solvent naphtha, turbine fuel or diesel fuel ranges. Preferred feedstocks normally contain at least about 10, preferably at least about 50 and most preferably at least about 75 volume percent of aromatic hydrocarbons. Specifically contemplated feeds comprise solvent fractions boiling in the range of about 300°-400° F., turbine fuel fractions boiling in the range of about 350°-500° F. and the like. Hydrocarbon oils finding particular use within the scope of this invention include coal-derived creosote oils, decant oils derived from FCC units and cracked cycle oils, usually containing about 60 to about 90 volume percent of aromatic hydrocarbons.

The catalyst is typically employed in a fixed bed of particulates in a suitable reactor vessel wherein the oils to be treated are introduced and subjected to elevated conditions of pressure and temperature, and ordinarily a substantial hydrogen partial pressure, so as to effect the desired degree of aromatic saturation of the aromatic hydrocarbons in the oil. The particulate catalyst is maintained as a fixed bed with the oil passing upwardly or downwardly therethrough, and most usually downwardly therethrough. Although any conventional method of catalyst activation may be employed, such catalysts employed in the process of the invention may be activated by being sulfided prior to use (in which case the procedure is termed "presulfiding"). Presulfiding may be accomplished by passing a sulfiding gas or sulfur-containing liquid hydrocarbon over the catalyst in the calcined form; however, since the hydrocarbon oils treated in the invention ordinarily contain sulfur impurities one may also accomplish the sulfiding in situ.

In the invention, a catalyst bed is contacted by a hydrocarbon oil fed from an upstream inlet location, through a single reactor containing the catalyst bed, to a downstream outlet location. The single reactor contains means for effecting different temperatures upon one or more upstream portions of the catalyst bed or upon one or more downstream portions of the bed during processing. Temperature controlling means include either cooling (quench) or heating gas streams (such as hydrogen gas) selectively positioned along upstream and downstream portions of the catalyst bed, and heat exchangers positioned along the bed. Alternatively, the catalyst may be utilized in two or more reactors, such as in a multiple train reactor system having the reactors loaded with one type of catalyst. In still another embodiment, one or more reactors may be loaded with one type of catalyst and the remaining reactors with one or more other catalysts. In the multiple reactor embodiments, temperature controlling means are typically located between reactors; however, it is within the scope of the invention that each reactor in a multiple train may also have temperature controlling means along the reactor catalyst bed, as for instance, by external heat exchange or a cold hydrogen quench. In either the single reactor system or the multiple reactor systems, the individual reactors are generally operated under an independent set of aromatic saturation conditions selected from those shown in the following TABLE A:

TABLE A

| Operating Conditions | Suitable Range | Preferred Range |
|---|---|---|
| Temperature, °F. | 300-900 | 400-850 |
| Hydrogen Pressure, p.s.i.g. | 150-3,500 | 400-3,000 |
| Space Velocity, LHSV | 0.01-20 | 0.05-10 |
| Hydrogen Recycle Rate, scf/bbl | 1,000-35,000 | 2,000-30,000 |

The weighted average catalyst bed temperature (WABT) for a typical commercial tubular reactor having a constant catalyst density and a linear temperature increase through the length of the bed is the average of the temperatures of the hydrocarbon oil at the inlet and outlet of the reactor. When the temperature increase through a catalyst bed is not linear, the temperatures of the weighted portions of the catalyst at selected bed locations must be averaged in accordance with the equation $(WABT)=\Sigma T\Delta W/W$ wherein WABT is the weighted average catalyst bed temperature, W is the weight of the catalyst, $\Delta W$ is the weight of a portion of the catalyst bed having a given average temperature T. (When the catalyst reactor bed has a constant catalyst density, then $\Sigma T\Delta W/W=\Sigma T\Delta L/L$ wherein L is the reactor bed length and $\Delta L$ is the length of a portion of the catalyst bed having a given average temperature T.) For example, a tubular reactor having a 15 foot catalyst bed with constant catalyst density and having a reactor inlet temperature of 700° F. and a reactor outlet temperature of 750° F. has a weighted average catalyst bed temperature of 716.7° F. when the temperatures are 705° F. and 720° F. at the 5 and 10 ft. catalyst bed positions, respectively.

Determination of the weighted average bed temperature of a portion of the overall catalyst bed in a single reactor (such as an upstream or downstream portion) is accomplished in the same manner as hereinbefore mentioned except the temperatures of the hydrocarbon oil cannot, in all cases, be measured at the inlet or outlet of the reactor. Temperatures along the catalyst bed of a single reactor are detected by temperature detecting means, such as thermocouples, positioned along the catalyst bed. The weighted average bed temperature of an upstream portion of a single reactor catalyst bed may be determined by a temperature at the inlet of the reactor and at a given location along the catalyst bed detected by a thermocouple. The weighted average bed temperature of a downstream portion of a single reactor catalyst bed may be determined by a temperature at a given location along the catalyst bed and at the outlet of the reactor.

In a single reactor embodiment, the upstream and downstream portions of the catalyst bed are contacted by an aromatics-containing hydrocarbon oil at aromatic saturation conditions including temperatures determined from saturation reaction rate kinetics and equilibrium concentrations of aromatics in the respective portions of the oil contacting the upstream and downstream portions of the catalyst. In general, an upstream portion of the catalyst bed is maintained at a base temperature which is higher than the temperature of a downstream portion of the catalyst bed. The temperatures (WABT) of downstream portions of the catalyst bed are determined from the equilibrium concentrations of aromatics contacting the corresponding downstream portions of the oil whereas the base temperatures (WABT) of upstream portions of the catalyst bed are initially determined from kinetic considerations including catalyst activity, and operating conditions, including space time, necessary to achieve a given degree of saturation, i.e., a given saturation reaction rate. (Space time as used herein is the amount of time the catalyst is in contact with the oil.) The base temperature (WABT) of an upstream portion of the catalyst bed must be sufficient to provide catalytic activity to saturate aromatics contained in the oil to provide a product hydrocarbon having a selected amount of aromatics remaining in the hydrocarbon oil, i.e., provide sufficient energy to achieve a desired saturation reaction rate. The temperature (WABT) of a downstream portion of the catalyst bed must be lower than the temperature of the upstream portion of the catalyst bed, yet still effect additional saturation of the aromatics remaining in the product hydrocarbon from the upstream catalyst bed so as to provide a second product hydrocarbon having a selected remaining amount of aromatics. According to the invention, a more favorable equilibrium exists between saturates and aromatics in the downstream portion of the catalyst bed at a lower temperature wherein the relative reaction rate constant is initially higher than that in the upstream catalyst bed. The net effect in the downstream portion of the catalyst bed is a higher reaction rate of aromatic saturation at a lower temperature.

In a preferred embodiment of the invention, hydrocarbon oil is successively passed through at least two reaction zones, i.e. an upstream first zone and a downstream second zone, each zone containing a catalyst having activity for saturating aromatic compounds, at aromatic saturation conditions including a temperature of about 400° F. to about 900° F. and at a space velocity (LHSV) of about 0.05 to about 3.0 and in the presence of hydrogen at a partial pressure of about 500 to about 3,000 p.s.i.g., employed at a recycle rate of about 1,000 to about 30,000 scf/bbl. Preferably, in an integrated process, the product hydrocarbon obtained from the first reaction zone is directly and rapidly passed into the second reaction zone; thus, a connective relationship exists between the zones. In this connective relationship, the pressure between the zones is maintained such that there is no substantial loss of hydrogen partial pressure.

The amount of aromatic saturation is evidenced by the volume percent of aromatic hydrocarbons remaining in the product hydrocarbon relative to the content of aromatics in the feedstock. Such a volume percentage is determined by analysis of the product hydrocarbon. Also, the volume percentage of aromatics may be calculated by subtracting the extent of the overall aromatic saturation reaction from 100 percent and multiplying by the aromatics content of the feedstock. In the process of the invention, the selected amount of aromatics remaining in the product hydrocarbon as a result of contact with a downstream portion of the catalyst bed at the selected lower temperature is dependent upon the particular product hydrocarbon specifications. For example, the process may be advantageously applied to reduce the aromatic content of turbine fuels (as for example, jet fuels) to less than 20 volume percent, and below 10 or 5 percent if desired. Typical diesel fuels may require a sufficiently low volume percent of aromatics to provide a desired cetane number. In general, at least 25, preferably at least 70 and most preferably at least 85 percent of the aromatic hydrocarbon compounds in the feedstock initially contacting the upstream portion of the catalyst bed (or first reaction zone) is converted (i.e., saturated) to nonaromatic hydrocarbon compounds in the product hydrocarbon obtained after contact of the downstream portion of the catalyst bed or from the effluent of the last reaction zone.

At the start or during the course of a processing run, the weighted average catalyst bed temperature in a downstream second reaction zone is intentionally lowered at least 5° F., preferably at least 10° F., and ordinarily in the range from about 20° F. to about 200° F., and preferably about 30° F. to about 150° F., as compared to the weighted average bed temperature of an upstream first reaction zone. To the same extent, the weighted average bed temperature of the first reaction zone may also be raised as compared to the weighted average bed temperature of the second reaction zone. Preferably throughout a run designed to obtain a selected amount of aromatics from a downstream second reaction zone, the difference between the inlet temperature in the first reaction zone and the inlet temperature in the downstream second reaction zone is at least 10° F., preferably at least 20° F. and most preferably at least 30° F. It is highly preferred that the inlet temperature of the downstream reaction zone be lower than both the inlet and outlet temperature of the first reaction zone, and typically by at least 10° F. and usually in the range from about 20° F. to about 100° F.

Although a substantial amount of aromatics are saturated in the upstream portions of the catalyst bed or in a first reaction zone, the lower temperature in the downstream bed portion or second reaction zone provides significant reduction of aromatics content in the second reaction zone as well.

The saturation of aromatic-containing hydrocarbon oils typically includes exothermic reactions. The heat generated from such reactions may increase the temperature of downstream portions of a catalyst bed. However, such transfer of heat downstream along a single catalyst bed, as in a single bed adiabatic reactor, is controlled within the scope of the present invention. In the process of the invention at a particular downstream location in the catalyst bed, a transfer of heat downstream is typically reduced by introduction of a coolant fluid (such as fresh hydrogen quench gas) so as to conform to the selected temperature required to obtain the selected concentration of aromatics from the particular downstream contacting location.

The selected amount of aromatics remaining in the hydrocarbon oil, particularly the amount remaining in the most downstream portion of the catalyst bed or last reaction zone, depends upon such factors as the extent of saturation possible at a temperature that provides a given reaction rate constant for the particular feedstock. Other factors include the activity of the catalyst, the equilibrium concentration of aromatics in the oil contacting the catalyst, operating conditions, and the like. In the single reactor embodiment, the upstream portion of the overall catalyst bed usually contains greater than about 50 volume percent and ordinarily about 50 to about 95 volume percent and preferably whereas the remaining downstream portions (at the lower temperature) of the overall catalyst bed usually contain less than 50 volume percent and ordinarily about 5 to about 50, and preferably about 15 to about 40 volume percent of the catalyst. In the multi-reactor embodiments, the upstream and downstream portions of the overall catalyst bed, i.e. the sum of all the catalyst in all the reactors, contain the same relative catalyst volume percentages as in the single reactor embodiment.

When the temperatures of downstream reaction zones are lowered relative to the upstream zones, the overall process of the invention results in a significantly reduced aromatic content as compared to an overall process employing the same catalyst at the same temperature in upstream and downstream reaction zones. Furthermore, in the invention, the aromatic saturation activity of the particulate catalyst employed at high and low temperatures is maintained for a considerably longer period of time than in the process employing the catalyst at the constantly higher temperature. Moreover, the overall multi-tier (high-low) temperature process of the invention provides more aromatic saturation of hydrocarbons than a process operated at an intermediate temperature in multiple reaction zones and further provides simultaneous improvement in cracking, desulfurization and denitrogenation.

The invention is further illustrated by the following example which is illustrative of specific modes of practicing the invention and are not intended as limiting the scope of the invention as defined in the appended claims.

EXAMPLE

In an embodiment involving three reactors, and equal volume of catalyst containing nickel and molybdenum hydrogenation metal components is successively contacted in each of three connected reactors under a constant hydrogen partial pressure of 2500 p.s.i.a. (recycle gas rate of 24,000 scf/bbl) with a creosote oil boiling in the range from about 150° F. to about 800° F. and initially containing at least about 50 volume percent of aromatic hydrocarbons (approximately 85 volume percent) and at least about 0.2 weight percent of sulfur (about 0.4 weight percent). The catalyst, having an average pore diameter about 70 angstroms, is initially contacted with the oil in the first two reactors at the same temperature and is then contacted in the downstream third reactor at a lower temperature with the product hydrocarbon obtained from the preceding upstream reactor. During the saturation process, the weighted average catalyst bed temperature of the catalyst in the first two reactors is maintained at the initial base temperature of 780° F., and then is lowered in the third reactor by approximately 60° F., (i.e., 720° F.). Both the inlet and outlet temperatures of the downstream third reactor are lower than either the inlet or outlet temperatures of the upstream first two reactors.

The location along the overall catalyst bed for the temperature decrease is determined from the corresponding relative reaction rate constants observed in relation to the space time of the oil with the catalyst. FIG. 1 illustrates the relative reaction rates of aromatic saturation in relation to the oil/catalyst space time. Shortly after a two (2) hour space time, the relative reaction rate constant at 780° F. is observed to decrease to approximately that at 720° F. At a three hour space time the relative reaction rate constant at 720° F. is observed to be substantially higher than that at the base temperature, i.e., at least twice the rate (approximately 55 vs. 24). Accordingly, the process of the invention provides, after slightly greater than about 2 hours space time for catalyst and oil in the upstream two reactors, that a significantly greater rate of aromatic saturation may be maintained in the downstream reactor at considerably lower temperatures than in the upstream two reactors. FIG. 1 also shows that subsequent sections of catalyst bed (i.e. additional reactors) at lower temperatures would further provide improved aromatic saturation.

The present invention provides a downstream temperature sufficient to saturate a specified amount of aromatic compounds at a corresponding downstream contacting location along the catalyst bed. The extent that the temperature is lowered at the downstream location along the catalyst bed is determined by where the aromatic saturation reaction rate constant at the upstream higher temperature decreases to within about 10 percent, and preferably within about 5 percent, of the observed aromatic saturation reaction rate constant at the downstream lower temperature. Preferably, during operation of the process of the invention, the reaction rate constant for the downstream section is initially higher than that for the upstream section for a selected extent of saturation reaction.

Figure 2:
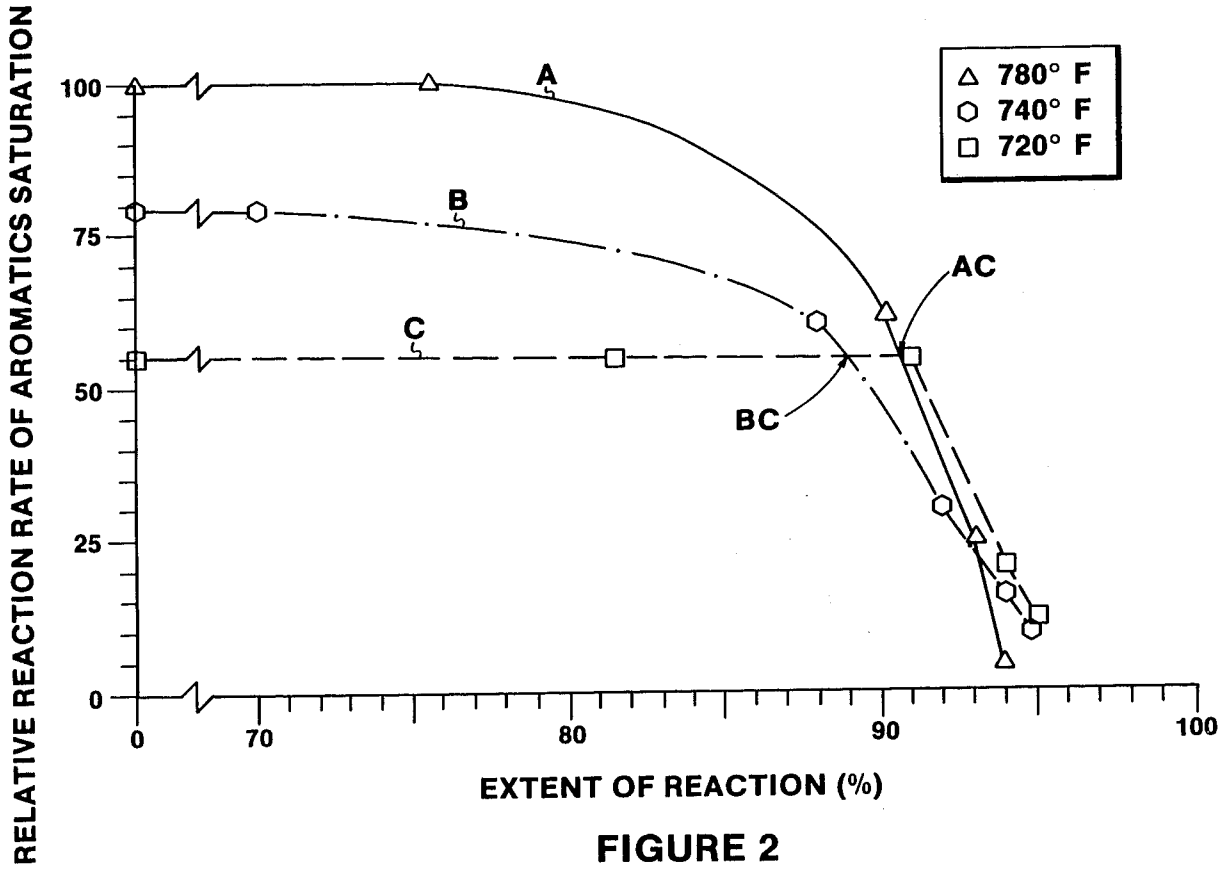
FIG. 2 illustrates the extent of the particular aromatic saturation-desaturation equilibrium reaction at constant pressure and catalyst/oil space time for relative saturation reaction rates in the process of the Example at 780° F., 740° F. and 720° F.

FIG. 2 illustrates the extent of the particular aromatic saturation-desaturation equilibrium reaction at constant pressure and catalyst/oil space time for relative saturation reaction rates in the process of the Example at 780° F. (Curve A), 740° F. (Curve B), and 720° F. (Curve C), respectively. The initial relative reaction rate constants observed at a base temperature (Curve A), base temperature less 40° F. (Curve B) and base temperature less 60° F. (Curve C) remain essentially unchanged through the first 75–78 percent of an overall aromatic saturation-desaturation reaction. The aromatics content in the product hydrocarbon is thus lowered to about 22–25 percent of the aromatics in the feedstock at such extent of reaction (100 minus 75–78 is 22–25). However, after the overall saturation reaction (net forward reaction) reaches about 91 percent (Point AC in FIG. 2) in the case of the 780° F. temperature (9 percent of the aromatics in the feedstock remaining unsaturated) and after it reaches about 89.4 percent (Point BC in FIG. 2) in the case of the 740° F. temperature (10.6 percent of aromatics in the feedstock remaining unsaturated), the overall extent of the saturation reaction is greatest in the case of 720° F. temperature and in accordance with the invention, the base temperature 780° F. is lowered 40° F. or 60° F. depending upon the desired extent of overall saturation reaction, i.e., product aromatic content. More surprising, the relative reaction rate constant in the case of the 720° F. temperature (Curve C) is at least five (5) times higher than that at the 780° F. temperature (Curve A) when the extent of the overall saturation reaction reaches about 94.5 percent (5.5 percent of the aromatics in the feedstock remaining unsaturated), i.e., the relative rate is 21.2 vs. 3.3. According to the method of the invention, if an upstream portion of the catalyst bed (or an upstream reaction zone) is operated at the above-mentioned base temperature and if the selected amount of aromatics remaining in the product hydrocarbon from the most downstream portion of the catalyst bed (or downstream reaction zone) translates to an extent of overall saturation reaction of, for example, more than 91 percent (i.e., less than 9 percent of the aromatics in the feedstock), the temperature of the downstream portion of the catalyst bed (or downstream reaction zone) is preferably lowered to about the base temperature less 60° F., i.e. 720° F. And, in this instance, the process still operates with a substantially higher saturation reaction rate constant at the lower downstream temperature. In general, the higher relative reaction rate constants for the downstream sections must be determined when the desired extent of overall saturation reaction is exceeded at lower reaction rates and will vary depending upon the hydrocarbon oil processed, i.e., the particular aromatic saturation-desaturation-equilibrium reaction and the particular catalyst.

While particular embodiments of the invention have been described, it will be understood, of course, that the invention is not limited thereto since many obvious modifications can be made, and it is intended to include within this invention any such modifications as will fall within the scope of the invention as defined by the appended claims.

We claim:

1. A catalytic process for promoting an equilibrium-limited aromatic saturation reaction in a hydrocarbon oil containing aromatic hydrocarbons, said catalytic process comprising the following steps:

(1) contacting an upstream portion of a catalyst bed containing a particulate catalyst in an upstream reaction zone under aromatic saturations conditions including a liquid hourly space velocity from about 0.01 to about 20 with said hydrocarbon oil to produce a product hydrocarbon oil containing less aromatic hydrocarbons than said hydrocarbon oil, and (2) contacting a downstream portion of said catalyst bed in a downstream reaction zone under aromatic saturation conditions, including a lower temperature than the temperature in step (1) and a liquid hourly space velocity from about 0.01 to about 20, with the product hydrocarbon obtained in step (1) to produce a second product hydrocarbon containing a lesser proportion of aromatic hydrocarbon than in said product hydrocarbon obtained in step (1), said temperature in step (2) being sufficient to saturate a selected amount of aromatic hydrocarbons from said product hydrocarbon obtained in step (1) to produce said second product hydrocarbon containing at least 25 percent less of said aromatic hydrocarbons than contained in said hydrocarbon oil contacting said catalyst in step (1), and said temperature in step (2) provides a relative reaction rate constant for said aromatic saturation reaction that is initially higher than the relative reaction rate constant for said aromatic saturation reaction provided by the temperature in step (1), and wherein the inlet temperature of said downstream reaction zone is lower than the inlet temperature of said upstream reaction zone.

2. The process defined in claim 1 wherein said contacting of said downstream portion of said catalyst bed is at a temperature at least 5° F. lower than said temperature of said contacting of said upstream portion of said catalyst bed.

3. The process defined in claim 1 wherein said contacting in step (1) and in step (2) occurs in the presence of hydrogen.

4. The process defined in claim 1 wherein said hydrocarbon oil contains at least about 50 volume percent of aromatic compounds.

5. The process defined in claim 1 wherein said hydrocarbon oil is selected from the group consisting of whole crude oils, atmospheric gas oils, thermally cracked gas oils, decant oils, vacuum gas oils, catalytically cracked gas oils, creosote oil, coal-derived oils, shale oils, turbine fuels, solvent naphtha and diesel fuels.

6. The process defined in claim 1 wherein quench gas contacts said downstream portion of said catalyst bed.

7. The process defined in claim 1 further comprising, in step (1), the simultaneous cracking of said hydrocarbon oil and, in step (2), the simultaneous cracking of said product hydrocarbon oil obtained in step (1).

8. The process defined in claim 1 further comprising, in step (1), the simultaneous removal of sulfur from said hydrocarbon oil and, in step (2), the simultaneous removal of sulfur from said product hydrocarbon obtained in step (1).

9. The process defined in claim 1 wherein about 50 to about 95 volume percent of said catalyst bed comprises said upstream portion of said catalyst bed and, in step (2), said selected amount of aromatic hydrocarbons in said second product hydrocarbon obtained in step (2) is in the range from about 1 percent to about 30 percent of the aromatic hydrocarbons contained in said hydrocarbon oil contacting said catalyst in step (1).

10. The process defined in claim 1 wherein at least about 60 volume percent of said catalyst bed comprises said upstream portion of said catalyst bed and the inlet and outlet temperatures of said downstream portion of said catalyst bed are lower than the inlet and outlet temperatures of said upstream portion of said catalyst bed.

11. A process for reducing the content of aromatic hydrocarbon compounds in a hydrocarbon oil containing sulfur and aromatic hydrocarbon compounds by catalyzing an equilibrium-limited aromatic saturation reaction, said process comprising successively contacting a catalyst under aromatic saturation conditions including a liquid hourly space velocity from about 0.01 to about 20 with said hydrocarbon oil in a first reaction zone to produce a product hydrocarbon oil containing less aromatic hydrocarbon compounds than said hydrocarbon oil and, subsequently, contacting a second portion of said catalyst with said product hydrocarbon oil obtained from said first reaction zone under aromatic saturation conditions including a liquid hourly space velocity from about 0.01 to about 20 in a second reaction zone to produce a second product hydrocarbon containing at least about 25 percent less of said aromatic hydrocarbon compounds than contained in said hydrocarbon oil contacting said catalyst in said first reaction zone, said second reaction zone having a lower inlet temperature and lower weighted average catalyst bed temperature than the inlet temperature and weighted average catalyst bed temperature of said first reaction zone, and said weighted average catalyst bed temperature in said second reaction zone providing a relative reaction rate constant for said aromatic saturation reaction that is higher than the relative reaction rate constant for said aromatic saturation reaction provided by the weighted average catalyst bed temperature of said first reaction zone.

12. The process defined in claim 11 wherein said weighted average catalyst bed temperature of said second reaction zone is at least 5° F. lower than the weighted average catalyst bed temperature of said first reaction zone.

13. The process defined in claim 11 wherein said weighted average catalyst bed temperature in said second reaction zone is about 20° F. to about 200° F. lower than the weighted average catalyst bed temperature of said first reaction zone.

14. The process defined in claim 11 wherein said contacting in said first reaction zone and in said second reaction zone occurs in the presence of hydrogen.

15. The process defined in claim 11 wherein said hydrocarbon oil contains at least 50 volume percent of said aromatic hydrocarbon compounds.

16. The process defined in claim 11 wherein at least about 60 volume percent of the total catalyst contained in both said first and said second reaction zones is contained in said first reaction zone and the inlet and outlet temperatures of said second reaction zone are lower than the inlet and outlet temperatures of said first reaction zone.

17. The process defined in claim 11 further comprising, in said first reaction zone, the simultaneous cracking of said hydrocarbon oil and, in said second reaction zone, the simultaneous cracking of said product hydrocarbon obtained from said first reaction zone.

18. The process defined in claim 11 further comprising, in said first reaction zone, the simultaneous removal of sulfur from said hydrocarbon oil and, in said second reaction zone, the simultaneous removal of sulfur from said product hydrocarbon obtained from said first reaction zone.

19. The process defined in claim 11 wherein said hydrocarbon oil is selected from the group consisting of whole crude oils, atmospheric gas oils, thermally cracked gas oils, decant oils, vacuum gas oils, catalytically cracked gas oils, creosote oil, coal-derived oils, shale oils, turbine fuels, solvent naphtha and diesel fuels.

20. A multi-reaction zone catalytic process for promoting an equilibrium-limited aromatic saturation reaction in hydrocarbon compounds contained in a hydrocarbon feedstock selected from the group consisting of coal-derived creosote oils, decant oils derived from oils processed in reactors containing fluid cracking catalysts and cracked cycle oils, said process comprising the following steps:

(1) contacting, in the presence of hydrogen, at least about 50 volume percent of a catalyst bed containing an aromatic saturation catalyst under aromatic saturation conditions including a liquid hourly space velocity from about 0.01 to about 20 with said hydrocarbon feedstock in a first reaction zone to promote saturation of said aromatic hydrocarbon compounds, said catalyst comprising at least one Group VIB metal hydrogenation component and at least one Group VIII metal hydrogenation component on a porous refractory oxide support containing alumina; and (2) contacting the remaining portion of said catalyst bed in a second reaction zone with the product hydrocarbon obtained from step (1) under aromatic saturation conditions including a weighted average catalyst bed temperature which is at least 20° F. lower than the weighted average catalyst bed temperature in said first reaction zone and a liquid hourly space velocity from about 0.01 to about 20, the inlet and outlet temperatures of said second reaction zone being lower than the inlet and outlet temperatures of said first reaction zone, said weighted average bed temperature in said second reaction zone providing a relative reaction rate constant for said saturation reaction that is initially higher than the relative reaction rate constant for the saturation reaction provided by said weighted average bed temperature in said first reaction zone, and wherein the product hydrocarbon obtained from step (2) contains less than about 50 percent of said aromatic hydrocarbon compounds contained in said feedstock.

* * * * *